US008178018B2

(12) United States Patent
Gaidjiergis et al.

(10) Patent No.: US 8,178,018 B2
(45) **Date of Patent: *May 15, 2012**

(54) METHODS FOR MANUFACTURING FIBER-CEMENT SOFFITS WITH AIR VENTS

(75) Inventors: Joe Gaidjiergis, Renton, WA (US); Lloyd Fladgard, Kingston, WA (US); Scott Fladgard, Kingston, WA (US)

(73) Assignee: PacTool International Ltd., Kingston, WA (US)

( * ) Notice: Subject to any disclaimer, the term of this patent is extended or adjusted under 35 U.S.C. 154(b) by 1819 days.

This patent is subject to a terminal disclaimer.

(21) Appl. No.: 10/039,064

(22) Filed: Jan. 4, 2002

(65) Prior Publication Data

US 2002/0109257 A1 Aug. 15, 2002

Related U.S. Application Data

(63) Continuation of application No. 09/415,088, filed on Oct. 8, 1999, now Pat. No. 6,468,453.

(51) Int. Cl.

| | |
|---|---|
| ***B28D 1/22*** | (2006.01) |
| ***B28B 11/12*** | (2006.01) |
| ***B26F 1/02*** | (2006.01) |
| ***B26F 1/08*** | (2006.01) |

(52) U.S. Cl. ..... 264/156; 264/155; 264/313; 425/290; 425/DIG. 37; 83/139; 83/660; 83/880; 83/669; 83/881; 83/684; 83/143

(58) Field of Classification Search ..... 264/155, 264/156, 313; 425/290, DIG. 37; 83/30, 83/660, 669, 684, 880, 881, 886, 139, 143
See application file for complete search history.

(56) References Cited

U.S. PATENT DOCUMENTS 2,225,342 A * 12/1940 Hyatt ..... 83/136
2,230,043 A * 1/1941 Moran ..... 83/138
2,445,210 A * 7/1948 Colton ..... 264/118
(Continued)

FOREIGN PATENT DOCUMENTS

DE 31 09 150 C1 9/1982
(Continued)

*Primary Examiner* — Christina Johnson
*Assistant Examiner* — Patrick Butler
(74) *Attorney, Agent, or Firm* — Perkins Coie LLP

(57) ABSTRACT

Methods and apparatuses for producing fiber-cement soffit building products. In one embodiment of the invention, an apparatus for producing fiber-cement soffits includes a punch assembly, a support assembly facing at least a portion of the punch assembly, and an actuator operatively coupled to at least one of the punch assembly or the support assembly. The punch assembly can include a punch plate and a plurality of punches coupled to the punch plate. Each punch can have a length and a first cross-sectional dimension generally normal to the length. The support assembly can have a support plate, and at least a portion of the support plate is juxtaposed to at least a portion of the punch plate. The support plate can include a plurality of holes arranged in a pattern so that each hole in the portion of the support plate juxtaposed to the punch plate is aligned with a corresponding punch on the punch plate. Each hole can have a second cross-sectional dimension greater than the first cross-sectional dimension of the punches to define a radial punch/hole clearance between each punch and each hole. The radial punch/hole clearance, for example, is generally greater than that of metal punch presses to allow the punches to be removed from a fiber-cement panel without delaminating portions of the panel.

28 Claims, 7 Drawing Sheets

U.S. PATENT DOCUMENTS

| | | | | | |
|---|---|---|---|---|---|
| 3,477,317 | A | * | 11/1969 | Liander | 76/107.1 |
| 3,719,736 | A | * | 3/1973 | Woodruff | 264/156 |
| 3,914,079 | A | * | 10/1975 | Kober | 425/394 |
| 3,962,941 | A | * | 6/1976 | Kober | 83/228 |
| 4,215,608 | A | * | 8/1980 | Herlan | 83/139 |
| 4,246,815 | A | * | 1/1981 | Hugo | 83/139 |
| 4,580,374 | A | * | 4/1986 | Quinnell | 52/95 |
| 4,586,360 | A | | 5/1986 | Jurgensmeyer et al. | |
| 4,653,365 | A | | 3/1987 | Takasaki et al. | |
| 4,985,119 | A | * | 1/1991 | Vinson et al. | 162/149 |
| 5,359,914 | A | * | 11/1994 | Brown | 83/139 |
| 5,437,758 | A | * | 8/1995 | Walsh, Jr. | 156/513 |
| 5,799,446 | A | * | 9/1998 | Tamlyn | 52/94 |
| 6,647,845 | B1 | * | 11/2003 | Ochi et al. | 83/139 |

FOREIGN PATENT DOCUMENTS

| | | |
|---|---|---|
| EP | 1 120 214 A1 | 8/2001 |
| GB | 1 472 908 | 5/1977 |
| GB | 1 497 980 | 1/1978 |
| JP | 08141992 | 6/1996 |
| WO | PCT/US00/27745 | 5/2000 |
| WO | WO 00/62988 | 10/2000 |

* cited by examiner

METHODS FOR MANUFACTURING FIBER-CEMENT SOFFITS WITH AIR VENTS

CROSS-REFERENCE TO RELATED APPLICATION

This application is a continuation of U.S. patent application Ser. No. 09/415,088, filed Oct. 8, 1999, now U.S. Pat. No. 6,468,453.

TECHNICAL FIELD

The present invention relates to construction materials to protect the exterior of houses and other structures. More particularly, the present invention relates to fiber-cement soffits for installation under the eaves of houses, commercial buildings and other structures.

BACKGROUND

A significant portion of the construction industry builds residential and commercial structures. Contractors generally build structures in-situ at specific sites, and "manufactured builders" generally build sections of structures in a factory for assembly at a particular site. In either application, the structures are generally framed, roofed and then covered with exterior siding materials. One particularly advantageous and popular type of siding is fiber-cement siding. Fiber-cement siding products are typically made from a composition having cement, cellulosic materials and a binder. The fiber-cement composition is pressed, cured and then cut into panels, shakes and planks to form finished siding products that are ready to be installed on a structure. Fiber-cement siding products are insect resistant, fire resistant, and wear resistant. Fiber-cement siding products can also be painted like wood, but they are not made from a valuable natural resource. Therefore, many contractors and manufactured builders are switching to fiber-cement siding products from wood, composites, aluminum, plastic and bricks.

Several buildings also have soffits installed under the eaves where the roof overhangs the exterior walls. Soffits are conventionally made from wood, metal (aluminum) or plastics. Soffits typically have large holes that are covered with a large mesh screen or thin slots to provide ventilation and to prevent insects or birds from nesting within the structure. The large holes, for example, are generally 1.5-3.0 inch diameter circles or 2×12 inch rectangles that are cut with a jig saw or a cylindrical saw. Wood and wood composite soffits, however, have several drawbacks because they are subject to insect infestation, warping, rotting and fire. Aluminum and plastic soffits also have drawbacks because they are difficult to paint, and thus the color of the soffits may be substantially different than the color of the paint on the exterior siding. Therefore, because fiber-cement building products do not suffer from the same drawbacks as wood, plastic or aluminum building products, many contractors and manufactured builders would like to install soffits made from fiber-cement.

Manufacturing fiber-cement products, however, can be difficult because fiber-cement building products are more difficult to process than wood, plastics or aluminum. For example, cutting fiber-cement products with circular saws (e.g., a rotating abrasive disk) produces a significant amount of dust that makes the working environment unpleasant and difficult to clean. Fiber-cement building products are also relatively brittle and can easily crack during processing. Moreover, fiber-cement building products are much more abrasive than wood, plastics or aluminum, and thus they wear through cutting tools very quickly. Fiber-cement soffits are particularly difficult to manufacture because it is difficult and time-consuming to form apertures in fiber-cement panels that allow air to flow through the soffits. Thus, fiber-cement soffits are not yet widely used in the marketplace.

One particularly promising fiber-cement soffit is a 12-foot fiber-cement panel having a plurality of ⅛ inch diameter apertures in a uniform, symmetrical pattern. Manufacturers of fiber-cement building products, such as James Hardy Building Products of Fontana, Calif., have experimented with manufacturing such fiber-cement soffits by drilling the apertures. Drilling the fiber-cement panel, however, is not generally feasible in large scale production because it is too time-consuming and the abrasive fiber-cement quickly wears down the drill bits. Drilling the fiber-cement panel also produces a fine dust that is unpleasant and difficult to clean. Therefore, drilling the apertures in the fiber-cement panel is not a viable manufacturing process.

To overcome the problems of drilling fiber-cement panels, manufacturers of fiber-cement building products have also experimented with punching individual holes through a fiber-cement panel using a sheet metal punch. Typical sheet metal punches have a very small clearance between the punch and the die. Punching apertures through the fiber-cement panel with a sheet metal punch is also not feasible because the sheet punch metal often sticks to the fiber-cement panel. The sheet metal punch may thus delaminate portions of the panel as it withdraws from the aperture. Punching apertures through the fiber-cement panel with a sheet metal punch may also produce a mushroom-shaped plug such that each aperture has a small opening on the front side but a much larger opening on the back side. In preliminary tests using a sheet metal punch to form apertures in a fiber-cement panel, the sheet metal punch ripped out so much material from the backside of the panel that a typical 12-foot soffit may not have sufficient structural integrity to be hung under the eaves of a structure.

SUMMARY OF THE INVENTION

The present invention is directed toward methods and apparatuses for producing fiber-cement soffit building products. In one embodiment of the invention, an apparatus for producing fiber-cement soffits includes a punch assembly, a support assembly facing at least a portion of the punch assembly, and an actuator operatively coupled to at least one of the punch assembly or the support assembly. The punch assembly can include a punch plate and a plurality of punches coupled to the punch plate. Each punch can have a length and a first cross-sectional dimension generally normal to the length. The support assembly can have a support plate, and at least a portion of the support plate is juxtaposed to at least a portion of the punch plate. The support plate can include a plurality of holes arranged in a pattern so that each hole in the portion of the support plate juxtaposed to the punch plate is aligned with a corresponding punch on the punch plate. Each hole can have a second cross-sectional dimension greater than the first cross-sectional dimension of the punches to define a radial punch/hole clearance between each punch and each hole. The radial punch/hole clearance, for example, is generally greater than that of metal punch presses to allow the punches to be removed from a fiber-cement panel without delaminating portions of the panel.

The actuator can be coupled to the punch plate to move the punches between a first position and a second position. In the first position, the punches are spaced apart from the support plate to allow a fiber-cement panel to pass between the punches and the support plate. In the second position, the punches penetrate into the fiber-cement panel to form a plurality of apertures in the fiber-cement panel. The apertures generally have a first opening on a front side of the panel facing the punches and a second opening on the backside of the panel facing the support plate. The first openings can have shapes corresponding to the first cross-sectional dimension of the punches, and the second openings are slightly larger than the first openings. The apertures are thus frustoconical with only a slight change in diameter from the top to the bottom.

The punch and support assemblies can have several different configurations. In one particular embodiment, the punch plate is a first flat plate and the support plate is a second flat plate. Other embodiments of the punch plate and support plate include first and second cylindrical members, or devices having other shapes that can be pressed together. The punches coupled to the punch plate and the holes in the support plate can also have several configurations. In one particular embodiment, the punches have a concave contact face and a first diameter defining the first cross-sectional dimension. The first diameter, for example, can be approximately 0.11-0.25 inch. The holes in the support plate of this embodiment have a second diameter defining the second cross-sectional dimension. The second diameter can be approximately 0.18-0.39 inches. The radial punch/hole clearance between the punches and the holes in these particular embodiments can accordingly be approximately 0.032-0.070 inch. The radial punch/hole clearance can also be a function of the thickness of the fiber-cement panel or the size of the punch. For example, the radial punch/hole clearance between the punches and the holes can be approximately 4%-40% of the thickness of the fiber-cement panel or approximately 4%-30% of the diameter of the holes.

In one particular embodiment, the punch assembly includes a plurality of punches having a concave contact face, a first diameter of approximately 0.115-0.135 inch, and a biasing element surrounding each punch. The support plate of this particular embodiment can have holes with a second diameter of approximately 0.150-0.250 inch.

In the operation of this particular embodiment, the actuator drives the punch assembly toward the support plate until the punches penetrate through only a portion of the fiber-cement panel. The punches accordingly do not pass completely through the panel in this embodiment. Although the punches penetrate the fiber-cement panel only to an intermediate depth, the punches remove a frustoconical shaped plug from the panel to produce apertures through the full thickness of the fiber-cement panel. The biasing elements also press against the panel to prevent the panel from sticking to the punches as the punches withdraw from the fiber-cement panel. In this particular embodiment, the radial punch/hole clearance and the biasing elements prevent the punches from sticking to the fiber-cement panel to avoid or prevent delamination of the fiber-cement at the apertures.

DETAILED DESCRIPTION OF THE INVENTION

The present invention is a method and apparatus for fabricating fiber-cement soffits and other building materials from fiber-cement panels. Several specific details of the invention are set forth in the following description and in FIGS. 1-6B to provide a thorough understanding of certain embodiments of the present invention. The following description also provides examples of the preferred embodiments of the invention. One skilled in the art, however, will understand that the present invention may have additional embodiments, or that other embodiments of the invention may be practiced without several of the specific features explained in the following description.

Figure 1:
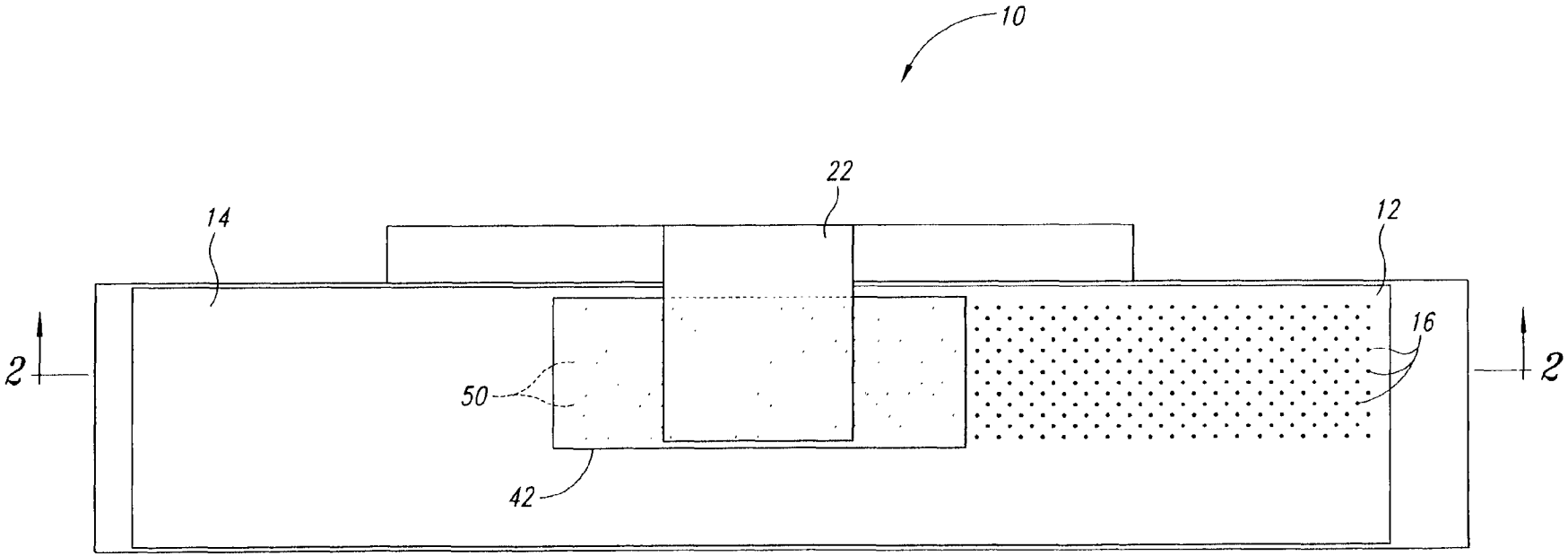
FIG. 1 is a top plan view of a punch press for producing a fiber-cement panel in accordance with one embodiment of the invention.
Figure 2:
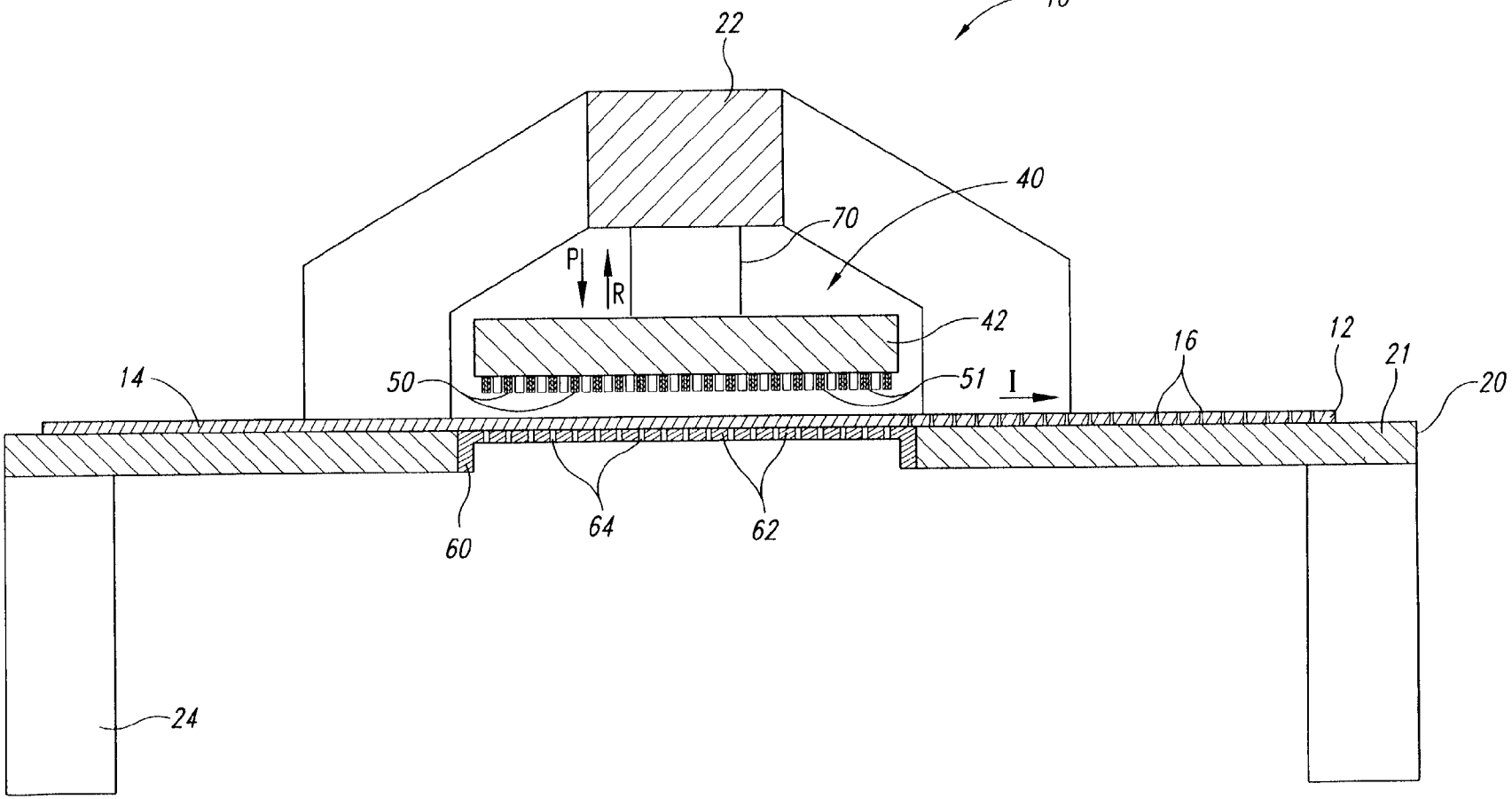
FIG. 2 is a cross-sectional side view of the punch press of FIG. 1 taken along line 2-2.

FIG. 1 is a top plan view and FIG. 2 is a side elevation view of a punch press 10 for producing a fiber-cement soffit 12 from a panel 14 of fiber-cement. The panel 14 is made from cement, a cellulosic material and a binder. James Hardy Building Products of Fontana, Calif. produces the panel 14 without any holes. The panel 14 is typically 4-48 inches wide, 8-16 feet long, and 0.25-0.625 inch thick. The punch press 10 produces the fiber-cement soffit 12 by forming a plurality of apertures 16 in the panel 14 without delaminating the panel 14 or removing an excessive amount of material from the backside of the panel 14.

As best shown in FIG. 2, the punch press 10 can have a support structure 20 with a support surface 21, an upper frame 22 and a lower frame 24. In this embodiment, the punch press 10 includes a punch assembly 40 having a punch plate 42 and a plurality of punches 50 coupled to the punch plate 42. Each punch 50 has length projecting downward from the punch plate 42 and a first cross-sectional dimension in a plane normal to the length. The first cross-sectional dimension can be circular, rectilinear, or any other suitable shape. The punches 50 are generally made from metal, ceramic, or other hard materials. The punch assembly 40 can also include a plurality of biasing elements 51 that press against the panel 14 when the punches 50 penetrate the panel 14. A biasing element 51 can be adjacent to each punch 50, or fewer biasing elements can be attached to the punch assembly 40. The biasing elements 51, for example, can be springs, compressible and resilient tubes made from rubber or another resilient material, or other types of compressible and resilient members.

The punch press 10 can also include a support assembly 60 having a support plate 62 with a plurality of holes 64. At least a portion of the support plate 62 is juxtaposed to the punch plate 42. The holes 64 can be arranged in the same pattern as the punches 50. When the punch plate 42 and the support plate 62 are flat plates, each hole 64 is generally aligned with a corresponding punch 50. Each hole 64 also has a second cross-sectional dimension greater than the first cross-sectional dimension of a corresponding punch 50 to provide a radial punch/hole clearance between each punch 50 and each hole 64. The radial punch/hole clearance is sufficient to allow the punches to be removed from the panel 14 without delaminating portions of the panel 14.

The punch press 10 further includes an actuator 70 that can be coupled to either the punch assembly 40 or the support assembly 60 to move the punches 50 and/or the support plate 62 toward one another. In the embodiment shown in FIGS. 1 and 2, the actuator 70 is attached to the upper frame 22, and the punch plate 42 is attached to actuator 70. The actuator 70 reciprocates the punch plate 42 and the punches 50 along a punch stroke "P" and a retraction stroke "R." The actuator 70 can be a hydraulic or pneumatic actuator that quickly drives the punch plate 42 along the punch stroke P, and then retracts the punch plate 42 along the retraction stroke R. Suitable actuators 70 for the punch press 10 are manufactured by Rouselle Press Company of Chicago, Ill. The punch press 10 generally operates by indexing the panel 14 across the support plate 62 (arrow I), and then reciprocating the punch plate 42 along the punch stroke P and the retraction stroke R to punch the apertures 16 in incremental sections of the panel 14.

Figure 3A:
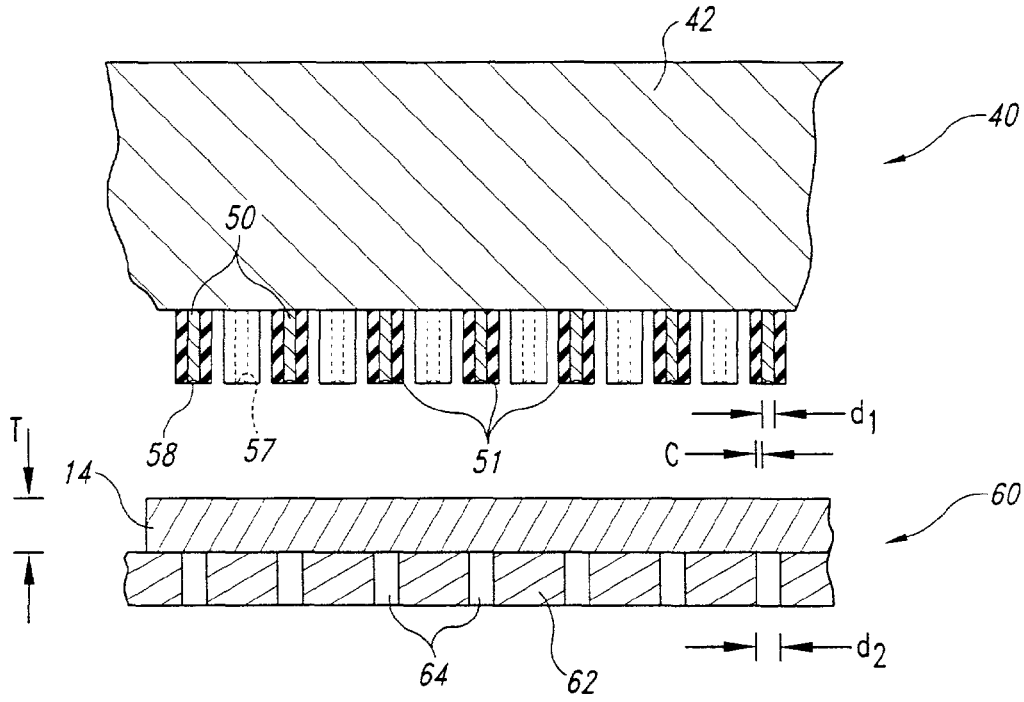
FIGS. 3A and 3B are partial cross-sectional views of a punch assembly and a support assembly of a punch press in accordance with one embodiment of the invention for producing a fiber-cement soffit from a fiber-cement panel.
Figure 3B:
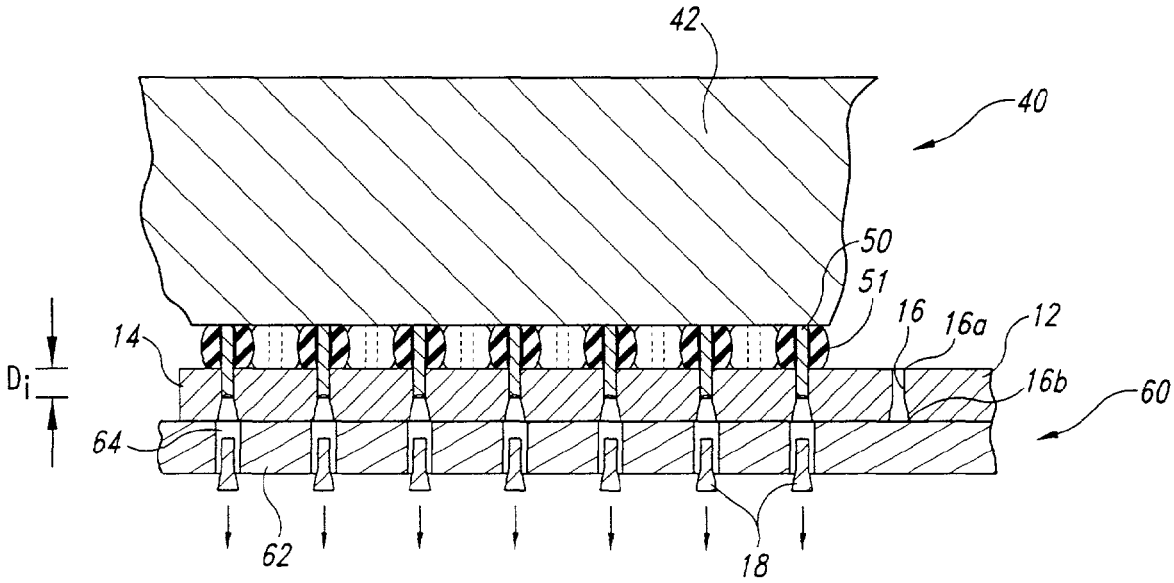

FIGS. 3A and 3B are partial cross-sectional views of the punch assembly 40 and the support assembly 60 in accordance with a particular embodiment of the punch press 10. Referring to FIG. 3A, the punch plate 42 is a rigid, flat plate. The punches 50 can be threadedly attached to the punch plate 42, and have a first diameter $d_1$ defining the first cross-sectional dimension. Each punch 50 can also have a concave contact face 57 and a sharp rim 58. A cylindrical biasing element 51 is threadedly attached to each punch 50. In this embodiment, the biasing elements 51 are polymeric tubes or sleeves that have lengths approximately equal to or exactly equal to the lengths of the punches 50.

The support plate 62 of FIG. 3A is also a flat, rigid plate that faces the punch plate 42. The holes 64 in the support plate 62 have a second diameter $d_2$ defining the second cross-sectional dimension. The second diameter $d_2$ is greater than the first diameter $d_1$ to provide the radial punch/hole clearance "C" between the punches 50 and the holes 64. The first diameter $d_1$ of the punches 50 and the second diameter $d_2$ of the holes 64 can be a function of the thickness of the panel 14, the size of the apertures 16, or other parameters. For a panel 14 having a thickness T of 0.25-0.3125 inch, the first diameter $d_1$ of the punches 50 can be approximately 0.11-0.25 inch, and the second diameter $d_2$ of the holes 64 can be approximately 0.18-0.39 inch. The clearance C between the punches 50 and the holes 64 for such a panel 14 can be approximately 0.032-0.125 inch, and more preferably approximately 0.04-0.07 inch. In further applications of the punch press 10, the radial punch/hole clearance C can be approximately 4%-30% of the second diameter $d_2$ of the holes 64, and more preferably approximately 23%-27% of the second diameter $d_2$. In still further applications of the punch press 10, the radial punch/hole clearance C is approximately 4%-40% of the thickness T of the panel 14, and more preferably 18%-27% of the thickness T.

In one particular embodiment of the punch press 10, the punches 50 initially have a first diameter $d_1$ of approximately 0.135 inch and the holes 64 have a second diameter $d_2$ of approximately 0.25 inch. The initial radial punch/hole clearance C is 0.0575 inch, or approximately 23% of the second diameter $d_2$. The fiber-cement composition of the panel 14, however, wears down the punches 50 such that the diameter $d_1$ of a shank portion of the punches 50 decreases. The diameter of the rim 58 of a punch 50 with a concave contact face 57 generally does not decrease as much as the shank, and thus the size of the apertures 16 do not decrease significantly as the shank of the punch wears down. When the diameter of the shank of the punch 50 is approximately 0.115 inch, the radial punch/hole clearance at the shank can be approximately 0.0675 inch. It is recommended that the punches 50 be replaced when the shank portions have a diameter of approximately 0.115 inch to avoid breakage of the punches 50.

FIG. 3B illustrates several aspects of operating the embodiment of the punch assembly 40 shown in FIG. 3A. The actuator 70 (FIGS. 1 and 2) drives the punch assembly 40 toward the support assembly 60 so that the punches 50 penetrate into the panel 14. In a typical application, the punches 50 do not pass completely through the panel 14, but rather the punches 50 stop at an intermediate depth $D_i$ in the panel 14. The intermediate depth $D_i$ is approximately 0.0625-0.1875 inch for a 0.25-0.31625 inch thick panel 14. In other embodiments of operating the punch assembly 40, the actuator 70 drives the punches 50 completely through the fiber-cement panel 14. As the punches 50 penetrate to the intermediate depth $D_i$, the fiber-cement panel 14 fractures along approximately conical paths to eject frustoconical plugs 18 from the fiber-cement panel 14. Each punch 50 accordingly forms an aperture 16 having a well-defined opening 16 at a front side of the soffit 12 facing the punch plate 42 and a slighter rougher opening 16 at a backside facing the support plate 62. The actuator 70 then retracts the punch assembly 40 to withdraw the punches 50 from the soffit 12. As the punches 50 withdraw from the soffit 12, the biasing elements 51 push the soffit 12 toward the support plate 62 to prevent the soffit 12 from sticking to the punches 50.

The particular embodiments of the punch press 10 shown in FIGS. 1-3B quickly produce large volumes of finished fiber-cement soffit. One feature of the punch press 10 is that the actuator 70 (FIGS. 1 and 2) can quickly reciprocate the punch assembly 40 along the punch stroke P and retraction stroke R (FIG. 2) to punch the apertures 16 through the desired length of the panel 14 in a matter of seconds. The embodiments of the punch press 10 shown in FIGS. 1-3B, therefore, can produce a high volume of finished fiber-cement soffit 12 in a short period of time with relatively inexpensive equipment.

The embodiments of the punch press 10 in FIGS. 1-3B produce the finished soffit 12 without producing noticeable amounts of dust or other small particulate matter. Unlike drills that produce small particles to form holes in the panel 14, the punch press 10 produces plugs 18 that fall to the floor and do not become an airborne contaminate. The punch press 10, accordingly, is not only easy to operate, but it also provides a clean, dust-free environment.

Another feature of the embodiments of the punch press 10 shown in FIGS. 1-3B is that they produce well-defined holes at both the front side and the backside of the soffit 12. In contrast to metal punches that have very tight tolerances between the punches and the dies (e.g., generally 0.03125 inch or less for 0.25-0.3125 inch thick metal sheets), the larger radial punch/hole clearance C between the punches 50 and the holes 64 reduces the size of the opening 16 (FIG. 3B) at the back side of the soffit 12. The resulting soffit produced with the embodiments of the punch press 10 shown in FIGS. 1-3B accordingly has good structural integrity compared to fiber-cement panels that have been punched with metal punch presses having much smaller radial punch/hole clearances.

The embodiments of the punch press 10 shown in FIGS. 1-3B also produce a fiber-cement soffit 12 in which the material at the apertures 16 does not delaminate. The radial punch/hole clearance C between the punches 50 and the holes 64 is large enough to reduce binding between the punches 50 and the fiber-cement panel 14. Additionally, the biasing elements 51 press against the fiber-cement panel 14 adjacent to the punches 50. As such, the combination of the downward force applied by the biasing elements 51 and the reduced friction between the punches 50 and the panel 14 allows the punches 50 to withdraw from the panel 14 without delaminating the fiber-cement material adjacent to the punches 50. Therefore, the embodiments of the punch press 10 shown in FIGS. 1-3B are expected to produce an extremely durable fiber-cement soffit 12.

Figure 4A:
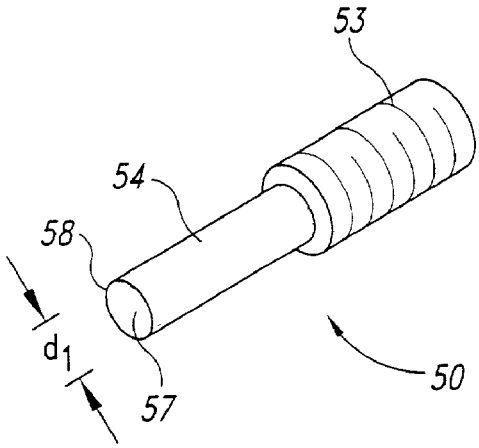
FIGS. 4A and 4B are side elevation views of punches in accordance with particular embodiments of the invention.
Figure 4B:
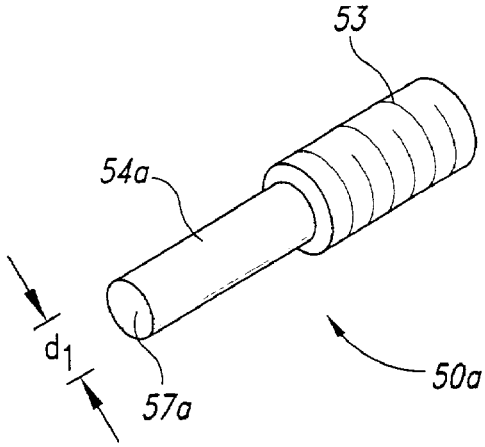

FIGS. 4A and 4B are side elevation views of different punches in accordance with particular embodiments of the invention. Referring to FIG. 4A, a punch 50 like the ones illustrated in FIGS. 3A and 3B is shown in more detail. The punch 50 can have a threaded section 53 to threadedly attach the punch 50 to the punch plate 42. The punch 50 can also have a punch section 54 with the first diameter $d_1$, a concave contact face 57, and a rim 58. The concave face 57 and the rim 58 are expected to provide better directional control of crack propagation through the panel 14 so that the difference between the opening 16*a* and the opening 16*b* is not significant. Referring to FIG. 4B, a punch 50 has a threaded section 53 and punch section 54 with a flat contact face 57*a*.

Figure 5:
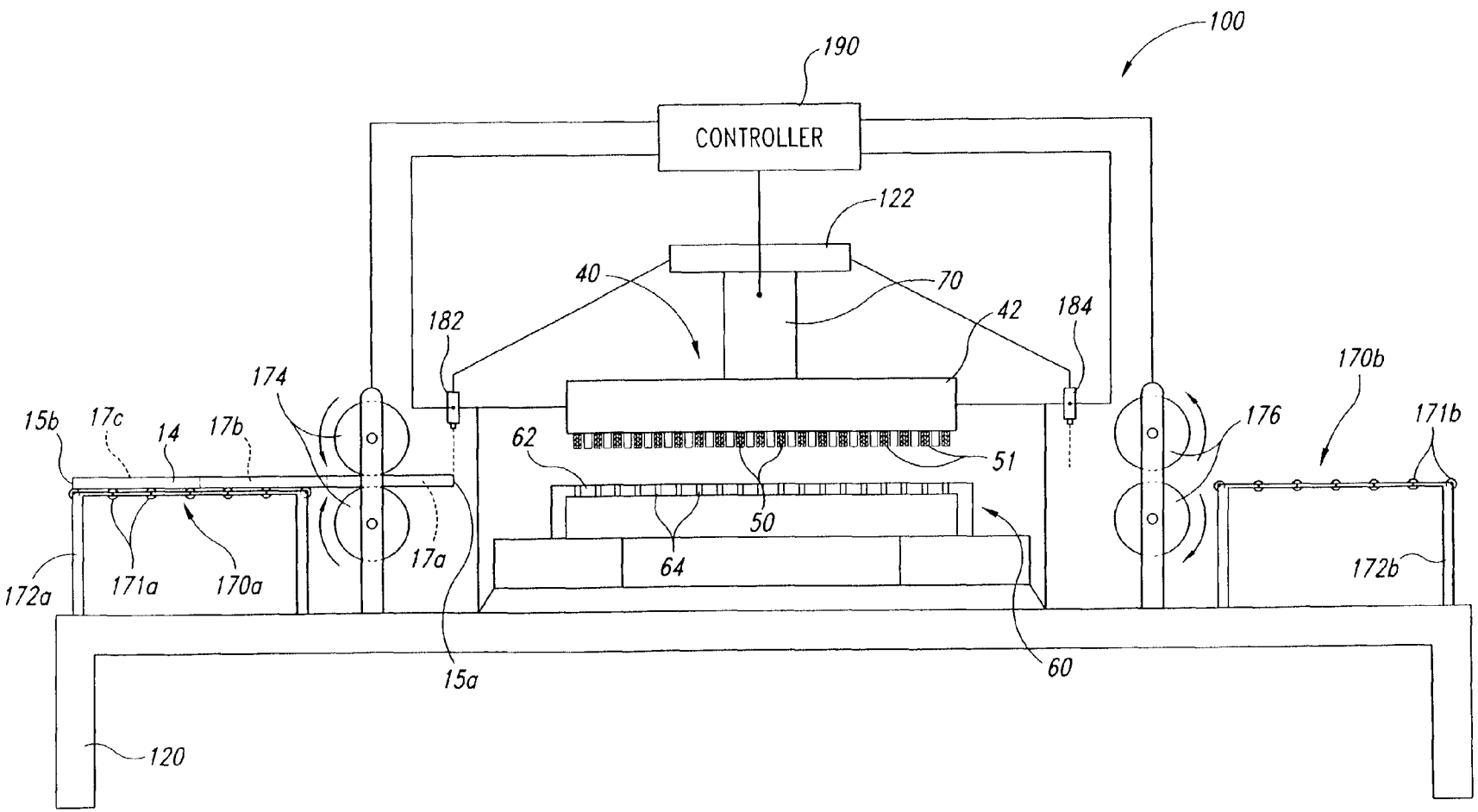
FIG. 5 is a schematic cross-sectional view of another punch press for producing a fiber-cement soffit from a fiber-cement panel in accordance with another embodiment of the present invention.

FIG. 5 is a schematic side elevation view of a punch press 100 that includes an indexing and control system in accordance with another embodiment of the invention. The punch press 100 can include a punch assembly 40, a support assembly 60 and actuator 70 similar to those described above with reference to FIGS. 1-4B. The actuator 70 can be attached to an upper frame 122, and the punch assembly 40 can be coupled to the actuator 70. The support assembly 60 can be coupled to the support structure 120 so that the support assembly 60 is juxtaposed to the punch assembly 40.

The punch press 100 can also include a first passive roller support array 170*a* on the feed side of the punch assembly 40, and a second passive roller array 170*b* on a discharge side of the punch assembly 40. The first passive roller array 170*a* generally includes a plurality of passive rollers 171*a* coupled to a frame 172*a*, and the second passive roller array 170*b* includes a plurality of second passive rollers 171*b* coupled to a second frame 172*b*. The first and second passive rollers 171*a* and 171*b* are positioned so that the upper apex of each passive roller is at an elevation at least proximate to the elevation of the support plate 62.

The punch press 100 also includes a first active roller assembly 174 between the first passive roller array 170*a* and the punch assembly 40, and a second active roller assembly 176 between the punch assembly 40 and the second passive roller array 170*b*. The first active roller assembly 174 initially moves the panel 14 into position under the punch assembly 40 and then incrementally feeds the panel 14 across the support assembly 60. The second active roller assembly 176 also feeds the panel 14 across the support assembly 60 and then discharges a finished fiber-cement soffit (not shown in FIG. 5) across the second passive roller array 170*b*.

The punch press 100 also includes a control system to coordinate the indexing of the panel 14 and the operation of the actuator 70 to incrementally punch apertures 16 (FIG. 3B) through portions of the panel 14. The control system can include a first position sensor 182 to sense a leading edge 15*a* of the panel 14, and a second position sensor 184 to sense a trailing edge 15*b* of the panel 14. The first position sensor 182 is preferably an optical sensor positioned between the first active roller assembly 174 and the punch assembly 40. The second position sensor 184 is preferably an optical sensor positioned between the punch assembly 40 and the second active roller assembly 176. The control system further includes a controller 190 coupled to the actuator 70, the first and second active roller assemblies 172 and 174, and the first and second position sensors 182 and 184. Suitable controllers for operating the punch press 10 are available from Rouselle Press Company.

The operation of the punch press 100 will now be described. The first active roller assembly 174 initially rotates at a relatively low rotational velocity to draw the panel 14 towards the punch assembly 40 until the leading edge 15*a* is aligned with the first position sensor 182. The first position sensor 182 sends a signal to the controller 190 indicating the location of the leading edge 15*a*, and the controller 190 resets the punch press 100 for a new cycle by confirming that the punch assembly 40 is in a raised position and by stopping the rotation of the first active roller assembly 174. The controller 190 then signals the first and second active roller assemblies 174 and 176 to rotate at a relatively high velocity for an initial incrementing distance to position a first section 17*a* of the panel 14 between the punch assembly 40 and the support assembly 60. The controller 190 stops the rotation of the first and second active roller assemblies 174 and 176 when the first section 17*a* of the panel 14 is in place. The controller 190 then initiates the punch stroke of the actuator 70 to drive the punches 50 into the first section 17*a* of the panel 14 and the retraction stroke of the actuator 70 to withdraw the punches 50 from the panel 14. The controller 190 subsequently initiates the first and second active roller assemblies 174 and 176 to move the panel 14 until a second section 17*b* of the panel 14 is aligned with the punch assembly 40 and the support assembly 60. The controller 190 repeats this operation until apertures are formed along a desired length of the panel. As the trailing edge 15*b* of the panel 14 passes underneath the second position sensor 184, this sensor sends a signal to the controller 190 that the punch press 100 is clear and ready for processing another panel 14. The second position sensor 184 accordingly prevents another panel 14 from being fed through the first active roller assembly 174 while another panel 14 is still under the punch assembly 40 to prevent damaging the punches 50 or jamming the punch press 100.

Figure 6A:
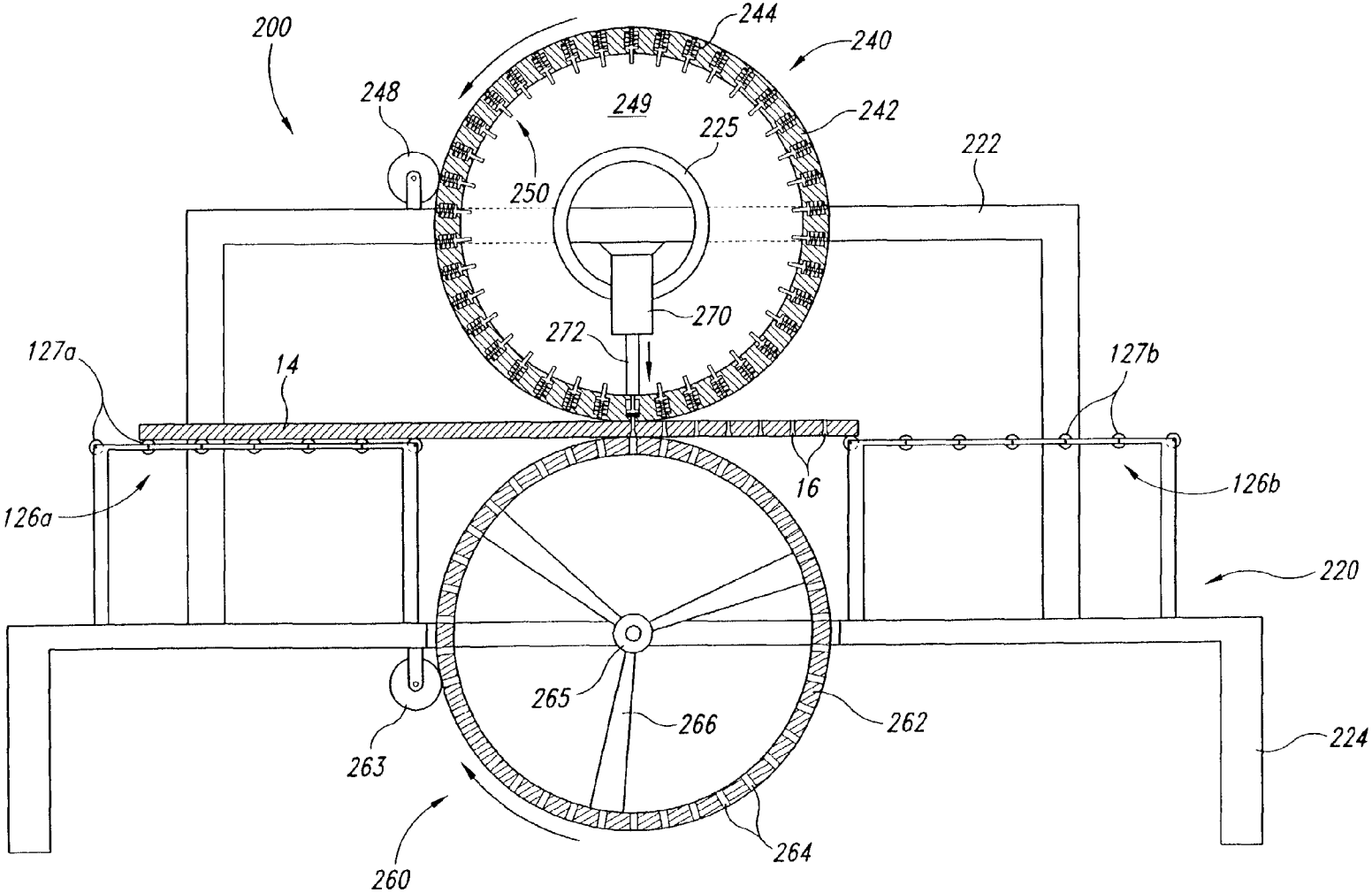
FIGS. 6A and 6B are partial cross-sectional views of still another punch press for producing a fiber-cement soffit from a fiber-cement panel in accordance with still another embodiment of the invention.
Figure 6B:
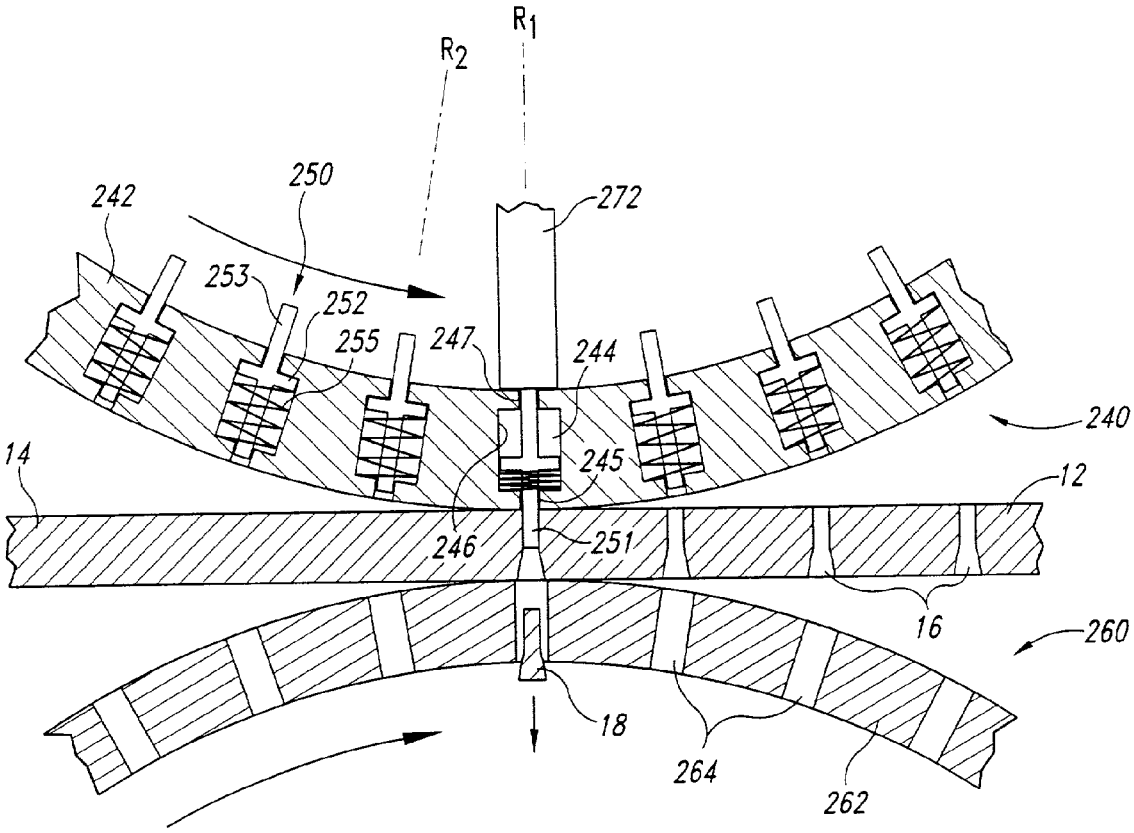

FIGS. 6A and 6B are schematic cross-sectional views of a punch press 200 in accordance with still another embodiment of the invention. Referring to FIG. 6A, the punch press 200 includes a support structure 220 having an upper frame 222 and a lower frame 224. The support structure 220 further includes a first passive roller assembly 126*a* having a plurality of passive rollers 127*a*, and a second passive roller assembly 126*b* having a plurality of second passive rollers 127*b*.

The punch press 200 also includes a punch assembly 240 and a support assembly 260. In this embodiment, the punch assembly 240 has a cylindrical punch plate 242 with a plurality of punch cavities 244 spaced radially apart from one another around the circumference of the punch plate 242. The cavities 244 can also extend in rows along an axial length of the cylindrical punch plate 242. The punch plate 242 has an end panel 249 or spokes attached to a ring bearing 225 on the upper frame 222 to rotatably attach the punch plate 242 to the support structure 220. The punch plate 242 can be driven by an active roller 248 attached to the upper frame 222. The support assembly 260 of this embodiment has a cylindrical support plate 262 rotatably attached to the lower frame 224 at a hub 265 by a number of spokes 266. The support assembly 260 can also include a drive roller 263 attached to the lower frame 224.

The punch press 200 further includes an actuator 270 attached to the upper frame 222 inside of the ring bearing 225. The actuator 270 has a ram 272 located within the cylindrical punch plate 242. The ram 272, for example, can be a plate extending along the axial length of the cylindrical plate 242.

FIG. 6B illustrates the punch assembly 240 and the support assembly 260 in further detail. The punch assembly 240 further includes a plurality of punches 250 received in the punch cavities 244 of the cylindrical punch plate 242. The punches 250 are preferably arranged in rows such that a row of punches 250 extends along the axial length of the cylindrical punch plate 242 at each radial position $R_1$, $R_2$, etc. Each punch cavity 244 has a first section 245 at the outer surface of the punch plate 242, a second section 246 having a larger cross-sectional than the first section 245, and a third section 247 with a smaller cross-section than the second section 246. The punch 250 has a punch section 251 in the first section 245 of the cavity 244, a shoulder 252 received in the second section 246 of the cavity 244, and a head 253 passing through the third section 247 of the cavity 244. Each punch 250 also has a biasing element 255 between the shoulder 252 and an outer rim of the second section 246 of the cavity 244 defined by the difference between the diameters of the first section 245 and the second section 246.

The punch press 200 operates by driving the ram 272 against the heads 253 of a row of punches 250 under the ram 272. The row of punches 250 and the row of holes 264 aligned with the ram 272 define an active punch set in a punch position. The actuator 70 then retracts the ram 272 so that the biasing elements 255 push the punches 250 toward the interior of the punch plate 242. The biasing elements 255 hold the shoulders 252 of the punches 250 against an inner rim defined by the difference between the diameters of the second section 246 and the third section 247 of the punch cavity 244 (shown as a passive punch set at radial location $R_2$ in FIG. 6B). The drive motors 248 and 263 can continuously rotate the punch plate 242 and the support plate 260 as the actuator 270 reciprocates the ram 272 to continuously punch apertures through the fiber-cement panel 14.

Although the foregoing sets forth specific embodiments of the invention, it will be appreciated that various modifications may be made to the specific embodiments described above without deviating from the spirit and scope of the invention. For example, the punch assembly 40 and the support assembly 60 can extend along the full length of the panel 14 so that all of the apertures 16 can be punched in one stroke of the actuator 70. Additionally, the apparatus and process can be used to punch holes in fiber-cement panels having diameters larger than 0.25 inch (e.g., 1.0-3.0 inches) with a radial punch/hole clearance of approximately 0.032-0.070 inch. Such large holes can then be covered with a mesh or screen to keep insects and birds out of protected spaces. The specific embodiments described above provide sufficient information to enable a person skilled in the art to make and use the best modes of the invention, but the claims are not limited to the particular embodiments described above. Accordingly, the invention is not limited except as by the appended claims.

The invention claimed is:

1. A method of fabricating a fiber-cement soffit, comprising:

providing a cured fiber-cement panel having a length, a width and a thickness;

placing the fiber-cement panel between a punch assembly and a support assembly, the punch assembly having a punch plate and a plurality of punches coupled to the punch plate, and the support assembly having a support plate with a plurality of holes;

driving the punches into and through at least a portion of the thickness of the fiber-cement panel to form a plurality of apertures in the fiber-cement panel by ejecting plugs from the fiber-cement panel through the holes in the support plate; and wherein the fiber-cement panel has a thickness of approximately 0.25-0.31625 inch, and wherein driving the punches comprises penetrating the punches into the panel to a depth of approximately 0.0625-0.1875 inch without passing the punches completely through the panel and thereby producing a ventilated fiber-cement soffit.

2. The method of claim 1 wherein driving the punches comprises penetrating the punches into the fiber-cement panel along the full length of the fiber-cement panel in one stroke of the punches.

3. The method of claim 1 wherein:

the punch assembly includes a flat punch plate and the plurality of punches project from the punch plate, the punches being spaced apart from one another by approximately 0.5-1.0 inch, and the punches having a first end attached to the punch plate, a second end opposite the first end with a contact face, and a first diameter of approximately 0.11-0.25 inch;

the support assembly includes a flat support plate and the plurality of holes extend through the support plate, each hole being aligned with a corresponding punch projecting from the punch plate, and the holes having a second diameter of approximately 0.18-0.39 inch to provide a radial punch/hole clearance between the punches and holes of approximately 0.04-0.07 inch; and driving the punches comprises moving the punches toward the holes and into the fiber-cement panel until the punches eject the plugs from the panel.

4. The method of claim 1 wherein:

the punch assembly includes a flat punch plate and the plurality of punches project from the punch plate, the punches being spaced apart from one another by approximately 0.5-1.0 inch, and the punches having a first end attached to the punch plate, a second end opposite the first end with a contact face, and a first diameter of approximately 0.11-0.25 inch;

the support assembly includes a flat support plate and the plurality of holes extend through the support plate, each hole being aligned with a corresponding punch projecting from the punch plate, and the holes having a second diameter of approximately 0.18-0.39 inch to provide a radial punch/hole clearance between the punches and holes of approximately 4%-30% of the second diameter of the holes; and;

driving the punches comprises moving the punches toward the holes and into the fiber-cement panel until the punches eject the plugs from the panel.

5. The method of claim 1 wherein:

the punch assembly includes a flat punch plate and the plurality of punches project from the punch plate, the punches being spaced apart from one another by approximately 0.5-1.0 inch, and the punches having a first end attached to the punch plate, a second end opposite the first end with a contact face, and a first diameter of approximately 0.11-0.25 inch;

the support assembly includes a flat support plate and the plurality of holes extend through the support plate, each hole being aligned with a corresponding punch projecting from the punch plate, and the holes having a second diameter of approximately 0.18-0.39 inch to provide a radial punch/hole clearance between the punches and holes of approximately 4%-40% of a thickness of the fiber-cement panel; and driving the punches comprises moving the punches toward the holes and into the fiber-cement panel until the punches eject the plugs from the panel.

6. A method of fabricating a fiber-cement soffit, comprising:

providing a cured fiber-cement panel having a thickness, and the fiber-cement panel comprising cement, cellulose material, and a binder;

placing the fiber-cement panel between a punch assembly and a support assembly, the punch assembly having a punch plate and a plurality of punches coupled to the punch plate, and the support assembly having a support plate with a plurality of holes;

driving the punches through at least a portion of the thickness of the fiber-cement panel to form apertures in the fiber-cement panel by ejecting plugs from the fiber-cement panel through the holes in the support plate;

withdrawing the punches from the fiber-cement panel without delaminating the fiber-cement panel at the apertures; and wherein the fiber-cement panel has a thickness of approximately 0.25-0.31625 inch, and wherein driving the punches comprises penetrating the punches into the panel to a depth of approximately 0.0625-0.1875 inch without passing the punches completely through the panel and thereby producing a ventilated fiber-cement soffit.

7. The method of claim 6 wherein the fiber-cement panel has a length, a width and a thickness, and wherein driving the punches comprises penetrating the punches into the fiber-cement panel along the length of the fiber-cement panel in one punch stroke.

8. The method of claim 6 wherein:

the punch assembly includes a flat punch plate and the plurality of punches project from the punch plate, the punches being spaced apart from one another by approximately 0.5-1.0 inch, and the punches having a first end attached to the punch plate, a second end opposite the first end with a contact face, and a first diameter of approximately 0.11-0.25 inch;

the support assembly includes a flat support plate and the plurality of holes extend through the support plate, each hole being aligned with a corresponding punch projecting from the punch plate, and the holes having a second diameter of approximately 0.18-0.39 inch to provide a radial punch/hole clearance between the punches and holes of approximately 0.04-0.07 inch; and driving the punches comprises moving the punches toward the holes and into the fiber-cement panel until the punches eject the plugs from the panel.

9. The method of claim 6 wherein:

the punch assembly includes a flat punch plate and the plurality of punches project from the punch plate, the punches being spaced apart from one another by approximately 0.5-1.0 inch, and the punches having a first end attached to the punch plate, a second end opposite the first end with a contact face, and a first diameter of approximately 0.11-0.25 inch;

the support assembly includes a flat support plate and the plurality of holes extend through the support plate, each hole being aligned with a corresponding punch projecting from the punch plate, and the holes having a second diameter of approximately 0.18-0.39 inch to provide a radial punch/hole clearance between the punches and holes of approximately 4%-30% of the second diameter of the holes; and driving the punches comprises moving the punches toward the holes and in to the fiber-cement panel until the punches eject the plugs from the panel.

10. The method of claim 6 wherein:

the punch assembly includes a flat punch plate and the plurality of punches project from the punch plate, the punches being spaced apart from one another by approximately 0.5-1.0 inch, and the punches having a first end attached to the punch plate, a second end opposite the first end with a contact face, and a first diameter of approximately 0.11-0.25 inch;

the support assembly includes a flat support plate and the plurality of holes extend through the support plate, each hole being aligned with a corresponding punch projecting from the punch plate, and the holes having a second diameter of approximately 0.18-0.39 inch to provide a radial punch/hole clearance between the punches and holes of approximately 4%-40% of a thickness of the fiber-cement panel; and driving the punches comprises moving the punches toward the holes and into the fiber-cement panel until the punches eject the plugs from the panel.

11. The method of claim 6 wherein withdrawing the punches from the fiber-cement panel comprises pressing resilient biasing members against the fiber-cement panel adjacent to at least a subset of the plurality of punches when the punches penetrate into fiber-cement panel.

12. The method of claim 6, further comprising:

providing a plurality of biasing elements coupled to the punch assembly, the biasing elements being compressible, resilient members projecting from the punch plate adjacent to a punch; and withdrawing the punches from the fiber-cement panel by pressing the biasing elements against the fiber-cement panel proximate to at least a subset of the punches as the punches penetrate the fiber-cement panel.

13. A method of fabricating a fiber-cement soffit, comprising:

providing a cured fiber-cement panel having a thickness of approximately 0.25-0.625 inch;

placing the fiber-cement panel between a punch assembly and a support assembly so that a first side of the panel faces the punch assembly and a second side of the panel faces the support assembly, the punch assembly having a punch plate and a plurality of punches coupled to the punch plate, and the support assembly having a support plate with a plurality of holes; and driving the punches through only a portion of the thickness of the fiber-cement panel to form a plurality of tapered openings in the fiber-cement panel and thereby producing a ventilated fiber-cement soffit.

14. The method of claim 13 wherein driving the punches comprises passing the punches along a punch stroke path to an intermediate depth of the fiber-cement panel without passing the punches completely through the panel and ejecting plugs from the panel in the direction of the punch stroke.

15. The method of claim 13 wherein:

the punches are arranged in an array and have a diameter of approximately 0.11-0.25 inch, and the holes are arranged in a corresponding array and have a diameter of approximately 0.18-0.39 inch to provide a radial punch-hole clearance between the punches and the holes of approximately 0.04-0.07 inch; and driving the punches comprises moving the punches along a punch stroke into the fiber-cement panel until the punches eject plugs from the panel in the direction of the punch stroke.

16. A method of fabricating fiber-cement soffit, comprising:

placing a cured fiber-cement panel between a punch assembly and a support assembly so that a first side of the panel faces the punch assembly and a second side of the panel faces the support assembly, the punch assembly having a punch plate and a plurality of punches having a first cross-sectional dimension coupled to the punch plate, and the support assembly having a support plate with a plurality of holes having a second cross-sectional dimension larger than the first cross-sectional dimension of the punches; and driving the punches through only a portion of the fiber-cement panel to form a plurality of openings in the fiber-cement panel that have the first dimension of the punches at the first side of the panel and the second dimension of the holes at the second side of the panel and thereby producing a ventilated fiber-cement soffit.

17. The method of claim 16 wherein driving the punches comprises passing the punches along a punch stroke path to an intermediate depth of the fiber-cement panel without passing the punches completely through the panel and ejecting plugs from the panel in the direction of the punch stroke.

18. The method of claim 16 wherein:

the punches are arranged in an array and have a diameter of approximately 0.11-0.25 inch, and the holes are arranged in a corresponding array and have a diameter of approximately 0.18-0.39 inch to provide a radial punch-hole clearance between the punches and the holes of approximately 0.04-0.07 inch; and driving the punches comprises moving the punches along a punch stroke into the fiber-cement panel until the punches eject plugs from the panel in the direction of the punch stroke.

19. The method of claim 16 wherein:

a clearance between the holes in the support plate and the punches is approximately between 4%-30% of the second dimension of the holes; and driving the punches comprises moving the punches along a punch stroke into the fiber-cement panel until the punches eject plugs from the panel in the direction of the punch stroke.

20. The method of claim 16 wherein:

a clearance between the holes in the support plate and the punches is approximately between 4%-40% of a thickness of the fiber-cement panel; and driving the punches comprises moving the punches along a punch stroke into the fiber-cement panel until the punches eject plugs from the panel in the direction of the punch stroke.

21. The method of claim 16 wherein:

a clearance between the holes in the support plate and the punches is approximately between 0.04-0.07 inch; and driving the punches comprises moving the punches along a punch stroke into the fiber-cement panel until the punches eject plugs from the panel in the direction of the punch stroke.

22. A method of fabricating fiber-cement soffit, comprising:

providing a cured fiber-cement panel having a length, a width, and a thickness, wherein the thickness is approximately 0.25-0.625 inch;

placing the fiber-cement panel between a punch assembly and a support assembly so that a first side of the panel faces the punch assembly and a second side of the panel faces the support assembly, the punch assembly having a punch plate and a plurality of punches having a first cross-sectional dimension coupled to the punch plate, and the support assembly having a support plate with a plurality of holes having a second cross-sectional dimension larger than the first cross-sectional dimension of the punches;

driving the punches along a punch stroke through at least a portion of the thickness of the fiber-cement panel to form a plurality of openings in the fiber-cement panel that have the first dimension of the punches at the first side of the panel and the second dimension of the holes at the second side of the panel; and pressing a compressible biasing element against the first side of the fiber-cement panel as the punches move along the punch stroke and thereby producing a ventilated fiber-cement soffit.

23. The method of claim 22 wherein driving the punches comprises punching holes into the fiber-cement panel along a full length of the panel in one punch stroke.

24. The method of claim 22 wherein driving the punches comprises passing the punches completely through the panel.

25. The method of claim 22 wherein:

the punches are arranged in an array and have a diameter of approximately 0.11-0.25 inch, and the holes are arranged in a corresponding array and have a diameter of approximately 0.18-0.39 inch to provide a radial punch-hole clearance between the punches and the holes of approximately 0.04-0.07 inch; and driving the punches comprises moving the punches into the fiber-cement panel to form openings having a dimension at the first side of the panel of approximately 0.11-0.25 inch.

26. The method of claim 22 wherein:

a clearance between the holes in the support plate and the punches is approximately between 4%-30% of the second dimension of the holes; and driving the punches comprises moving the punches into the fiber-cement panel to form openings having a first dimension at the first side of the panel and a second dimension larger than the first dimension at the second side of the panel.

27. The method of claim 22 wherein:

a clearance between the holes in the support plate and the punches is approximately between 4%-40% of a thickness of the fiber-cement panel; and driving the punches comprises moving the punches into the fiber-cement panel to form openings having a first dimension at the first side of the panel and a second dimension larger than the first dimension at the second side of the panel.

28. The method of claim 22 wherein:

a clearance between the holes in the support plate and the punches is approximately between 0.04-0.07 inch; and driving the punches comprises moving the punches into the fiber-cement panel to form openings having a first dimension at the first side of the panel and a second dimension larger than the first dimension at the second side of the panel.

* * * * *